US006860174B2

(12) United States Patent
Kusama

(10) Patent No.: US 6,860,174 B2
(45) Date of Patent: Mar. 1, 2005

(54) HAND-HELD POWER TOOL

(75) Inventor: Masahiko Kusama, Wentzville, MO (US)

(73) Assignee: S.P. Air Kabusiki Kaisha, Nagano Pref. (JP)

( * ) Notice: Subject to any disclaimer, the term of this patent is extended or adjusted under 35 U.S.C. 154(b) by 36 days.

(21) Appl. No.: 10/346,334

(22) Filed: Jan. 17, 2003

(65) Prior Publication Data

US 2003/0150298 A1 Aug. 14, 2003

Related U.S. Application Data

(63) Continuation-in-part of application No. 10/052,934, filed on Oct. 19, 2001, now abandoned, which is a continuation-in-part of application No. 09/731,400, filed on Dec. 6, 2000, now abandoned.

(51) Int. Cl.[7] ..... B25B 13/46
(52) U.S. Cl. ..... 81/57.39; 81/57.13; 81/57.29
(58) Field of Search ..... 81/57.39, 57.13, 81/57.29, 57.11, 57.14, 57.3, 57.44

(56) References Cited

U.S. PATENT DOCUMENTS

| | | | | |
|---|---|---|---|---|
| 3,039,340 A | | 6/1962 | Livermont | |
| 3,896,686 A | * | 7/1975 | Swinney | 81/484 |
| 4,086,829 A | | 5/1978 | Hudgins | |
| 4,346,630 A | | 8/1982 | Hanson | |
| 4,722,252 A | | 2/1988 | Fulcher et al. | |
| 4,766,784 A | | 8/1988 | Lai | |
| 4,791,836 A | | 12/1988 | D'Haem et al. | |
| 5,142,952 A | * | 9/1992 | Putney et al. | 81/57.39 |
| 5,237,885 A | | 8/1993 | Putney et al. | |
| 5,255,578 A | | 10/1993 | Liou | |
| 5,450,773 A | | 9/1995 | Darrah et al. | |
| 5,535,646 A | | 7/1996 | Allen et al. | |
| 5,836,220 A | | 11/1998 | Valente | |
| 5,896,789 A | | 4/1999 | Giardino | |
| 5,967,002 A | | 10/1999 | Pijanowski | |
| 6,109,141 A | | 8/2000 | Nurmi | |

FOREIGN PATENT DOCUMENTS

| | | |
|---|---|---|
| EP | 0 285 888 A1 | 10/1988 |
| EP | 0 908 273 | 4/1999 |

OTHER PUBLICATIONS

European Patent Office, Search Report, May 26, 2004, Munich.

Snap–On Tools Company, *Blue–Point: Operator Instructions*, Jun. 1995, 4 pages, Japan.

PCT European Search Report, Mar. 21, 2002, Munich, 2 pages.

* cited by examiner

*Primary Examiner*—Hadi Shakeri
(74) *Attorney, Agent, or Firm*—Senniger Powers

(57) ABSTRACT

A hand-held power tool for inhibiting uncalled-for rotation of the output shaft and for self-compensating for wear. The tool comprises a housing, a braking member fixedly mounted in the housing and an output shaft mounted in the housing for rotation. The output shaft has an outer end portion for reception of an attachment. A ratchet wheel on the output shaft is adapted to be driven in one direction or the other, has a side face facing a first surface of a wear member, and has a plurality of recesses extending inward from the side face. The wear member is keyed to the output shaft for conjoint rotation. A plurality of engagement members are received one in each recess and biased outward against the first surface to bias a second surface of the wear member against the braking member for holding the ratchet wheel against rotation opposite the driven direction.

17 Claims, 5 Drawing Sheets

HAND-HELD POWER TOOL

CROSS REFERENCE TO RELATED APPLICATIONS

This application is a continuation-in-part of U.S. application Ser. No. 10/052,934, filed Oct. 19, 2001, which is a continuation-in-part of U.S. application Ser. No. 09/731,400, filed Dec. 6, 2000. The foregoing applications are incorporated herein by reference in their entirety.

BACKGROUND OF THE INVENTION

This invention relates generally to hand-held power tools, more particularly to a hand-held pneumatically powered tool having an output shaft and a reversible ratchet wheel drive therefor.

The invention is especially concerned with a hand-held pneumatically powered tool primarily of the type disclosed in U.S. Pat. No. 5,535,646 dated Jul. 16, 1996 entitled Ratchet Drive, also of the type disclosed in the coassigned U.S. Pat. No. 6,158,528 dated Dec. 12, 2000, entitled Hand-Held Pneumatic Rotary Drive Device, and in the coassigned copending application of Apr. 20, 2000, Ser. No. 09/553,921, entitled Hand-Held Power Tool, all these being incorporated herein by reference.

Referring to said U.S. Pat. No. 5,535,646 (briefly the '646 patent), the tool disclosed therein is shown to include an arrangement of washers including a friction washer (numbered 36) and one or preferably two Belleville spring washers (numbered 38) which combination, as stated in lines 58–60 of column 3 of the specification of the patent, "serves to pre-load the drive gear axially and prevent oscillation thereof." The primary purpose of this arrangement of washers is to inhibit uncalled-for rotation of the "drive gear" numbered 22 (the ratchet wheel), such as retrograde rotation thereof when the tool is set for driving the ratchet wheel in one or the other direction, as may be caused by back-drag of the pawl which has been selected for driving the ratchet wheel. Such retrograde rotation has the effect of detracting from the power of the tool. In this regard it may be observed that since in the use of the tool the ratchet wheel may be driven forward in one direction by the one pawl and forward in the other direction by the other pawl it is not possible to use means such as a back-check pawl for positively preventing retrogressive rotation of the ratchet wheel. While the '646 patent arrangement of washers has been generally satisfactory for the purpose, it has encountered the problem of relatively short life due to washer wear and the consequent necessity for shimming up the arrangement or replacing washers.

One attempt to solve the problem of rapid wear is shown in U.S. Pat. No. 4,722,252. The Belleville washer is replaced by coil springs received in holes in the ratchet wheel which bias ball bearings against a wear washer. An advantage is that the ball bearings can be of a hardness similar to that of the wear washer. However, because the ball bearings engage the wear washer substantially at a point, the ball bearings act like cutters as the tool operates and the ball bearings move in a circular path over the wear washer, damaging the wear washer and reducing service life. Still another solution may be found in U.S. Pat. No. 5,896,789, in which ball bearings are eliminated and springs move in a circular path to directly engage a non-rotating wear washer. To work, the ends of the springs must be machined flat, which adds cost to production. In addition, the surface area of engagement between the springs and washer is still very small. Moreover, it is difficult to economically use springs which are sufficiently hard for wear purposes, but retain the needed resiliency. A further solution may be found in published Operator Instructions for Blue-Point® ratchet wrenches, model numbers AT2000 and AT205A, published by Snap-on Tools Company, in which two springs are used with two pins that directly engage a thrust washer. As with the springs alone, the contact area of the pins is much smaller than the area of the thrust washer, which leads to excess wear of the thrust washer as the pins move in a circular path across its surface.

BRIEF SUMMARY OF THE INVENTION

Accordingly, among the several objects of this invention may be noted the provision of a tool having the reversible ratchet type of drive with improved means for inhibiting uncalled-for rotation of the ratchet wheel and shaft; the provision of a tool with such means which is relatively self-compensating for wear, and which is relatively long-lived and does not require shimming or replacement often as the washer arrangement; and the provision of such means which is relatively readily and economically incorporated in the tool.

A hand-held power tool comprising a housing and a braking member fixedly mounted in the housing. An output shaft is mounted in the housing for rotation in one direction or the other on an axis extending through the housing. The output shaft has an outer end portion projecting out from the housing for reception of an attachment for the tool and a ratchet wheel adapted to be driven in one direction or the other for rotating the output shaft in the one direction or the other. The ratchet wheel has a side face having a plurality of recesses extending inward from the side face spaced at intervals around the axis. A plurality of engagement members are received one engagement member in each recess and biased outward from a corresponding recess. A wear member is rotatable with the output shaft in one direction or the other. The side face of the ratchet wheel faces a first surface of the wear member and the engagement members engage the first surface of the wear member to bias a second surface of the wear member, opposite the first surface, against the braking member for holding the ratchet wheel against rotation in a direction opposite the driven direction of rotation.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
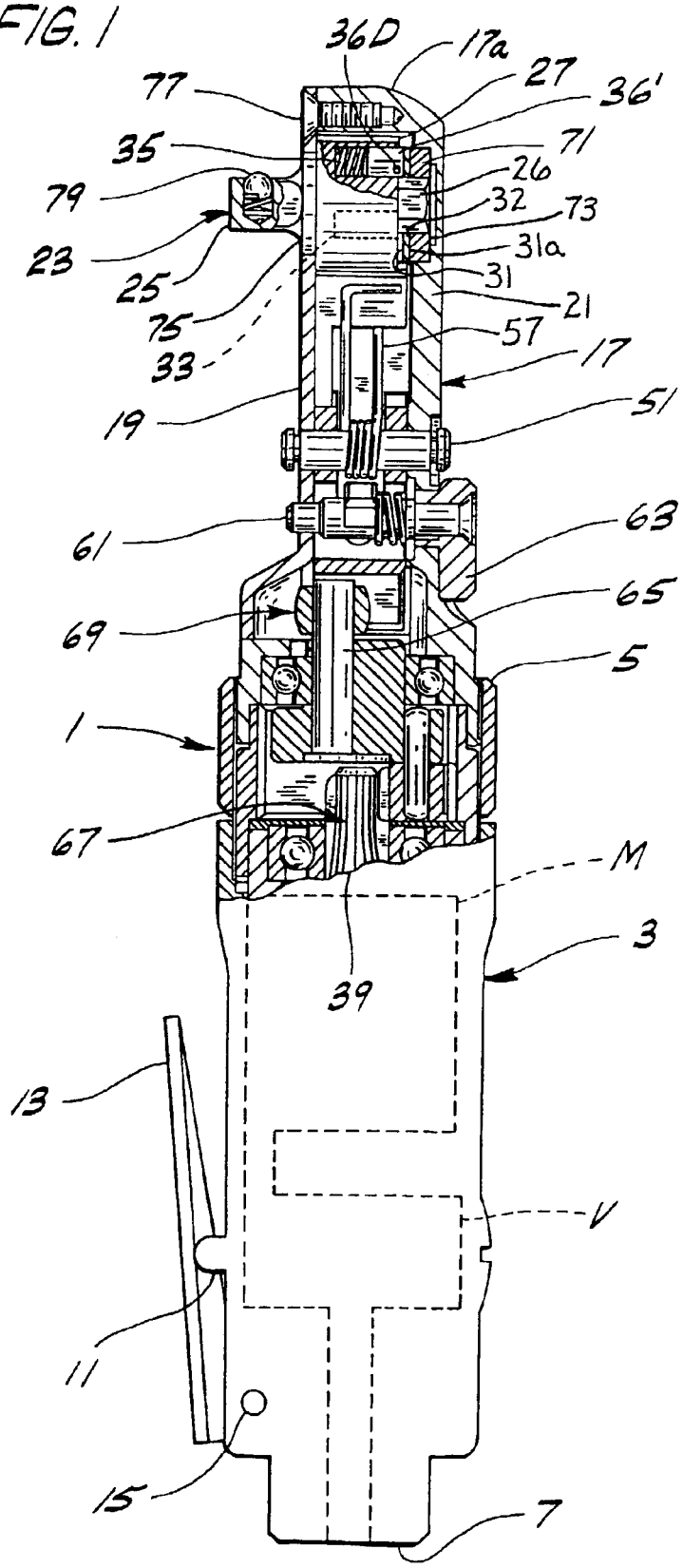
FIG. 1 is a view in side elevation of a reversible-ratchet tool having means of this invention incorporated therein, broken away in part to show interior detail including the means.

Referring to FIG. 1 of the drawings, a hand-held pneumatic power tool equipped with means of this invention for inhibiting uncalled-for rotation of the ratchet wheel (and output shaft) thereof, including the detrimental retrograde rotation above mentioned, is shown to comprise a generally elongate body sized and shaped to be held in the hand. The tool as a whole is generally designated 1, the elongate body is generally designated 3. The body has a forward end 5 and a rearward end 7 ("forward" and "rearward" as held in the hand). It is generally circular in transverse cross-section, having a motor chamber adjacent its forward end and a pneumatic motor M in the chamber, as is shown in said '646 patent and/or in said coassigned patent applications. The body 3 is adapted at its rearward end 7 for connection of an air hose (not shown) for delivering air under pressure for operating the motor M under control of a valve V in the body, the valve including stem 11 operable by lever 13 pivoted at 15. This connection may be as shown in said '646 patent or said coassigned patent applications. Details of the motor M, valve V, passaging in the body 3 for flow and exhaust of air, and the bidirectional ratchet drive mechanism may be ascertained from the aforesaid '646 and '528 patents and coassigned patent applications which, as above noted, are incorporated herein by reference.

Figure 2:
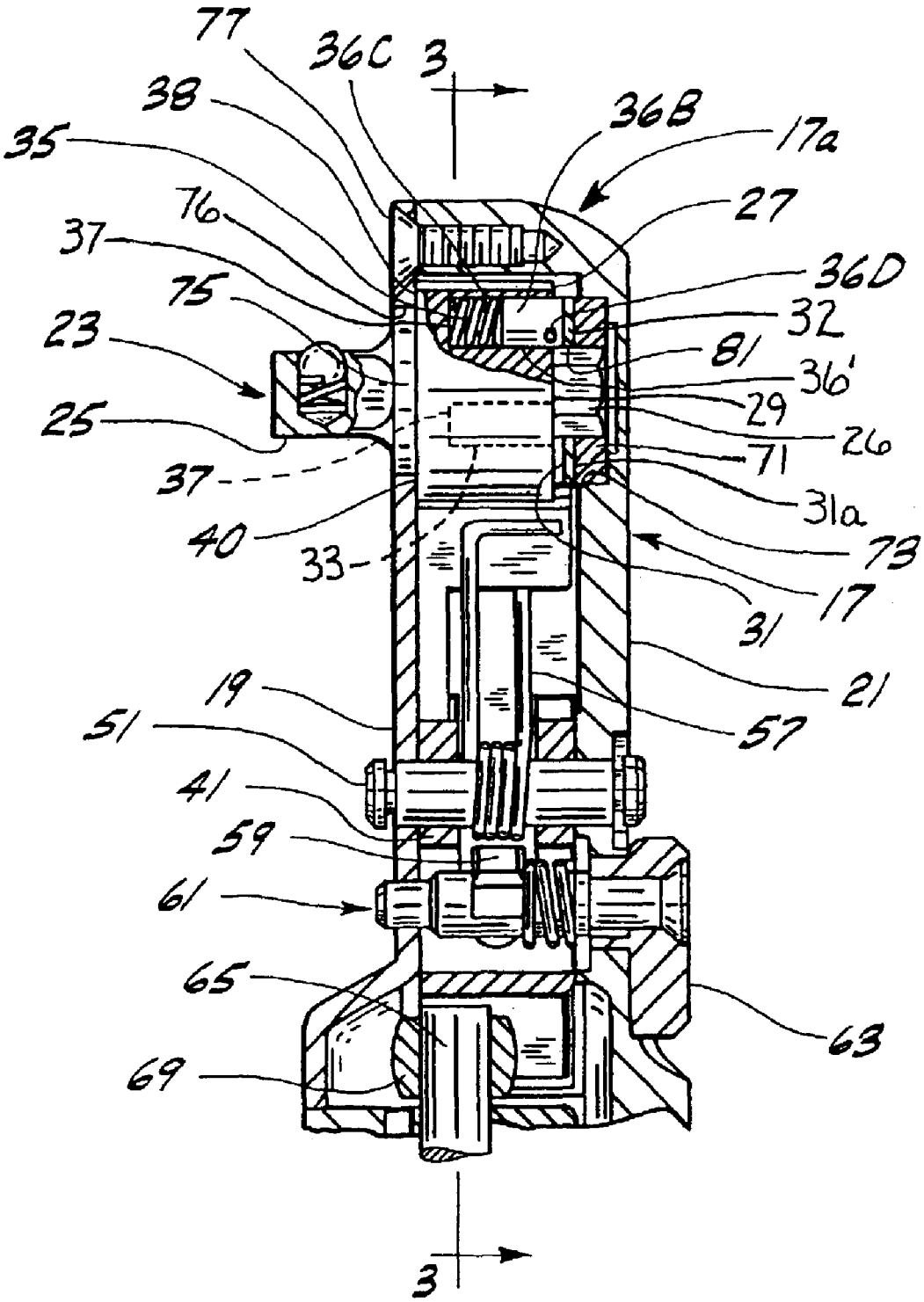
FIG. 2 is an enlarged fragment of FIG. 1.

Referring now to FIG. 2, extending forward from body 3 is a housing generally designated 17 having spaced walls 19 and 21, the wall 19 being referred to as the front wall and the wall 21 being referred to as the back wall. At 23 is indicated generally an output shaft mounted in the housing 17 adjacent the forward end 17*a* thereof for rotation in one direction or the other on an axis extending transversely with respect to the walls 19, 21. The shaft 23 has an outer end portion 25 projecting out from the front wall 19 for reception of an attachment for the tool 1. The shaft 23 also includes an internal end portion 26, opposite the end portion 25, journalled in an annular bearing 71, which also acts as a braking member as discussed below, mounted in a circular recess 73 in the inside of back wall 21 of housing 17. A spur gear constituting a ratchet wheel 27 is provided on the shaft 23 in the space between walls 19, 21. The ratchet wheel 27 is adapted to be driven in one direction or the other for rotating the output shaft 23 in the one direction or the other by the motor M in the body 3 acting through a bi-directional ratchet drive mechanism of the type shown in the aforesaid '646 patent and coassigned patent applications.

Figure 6:
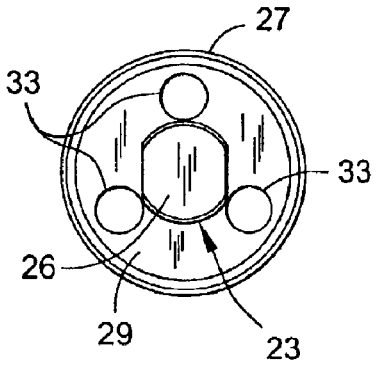
FIG. 6 is a right side elevation of FIG. 4.
Figure 6A:
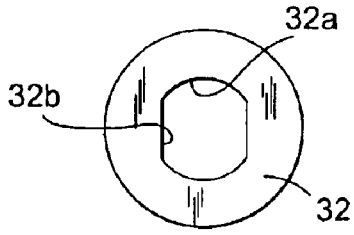
Figure 7:
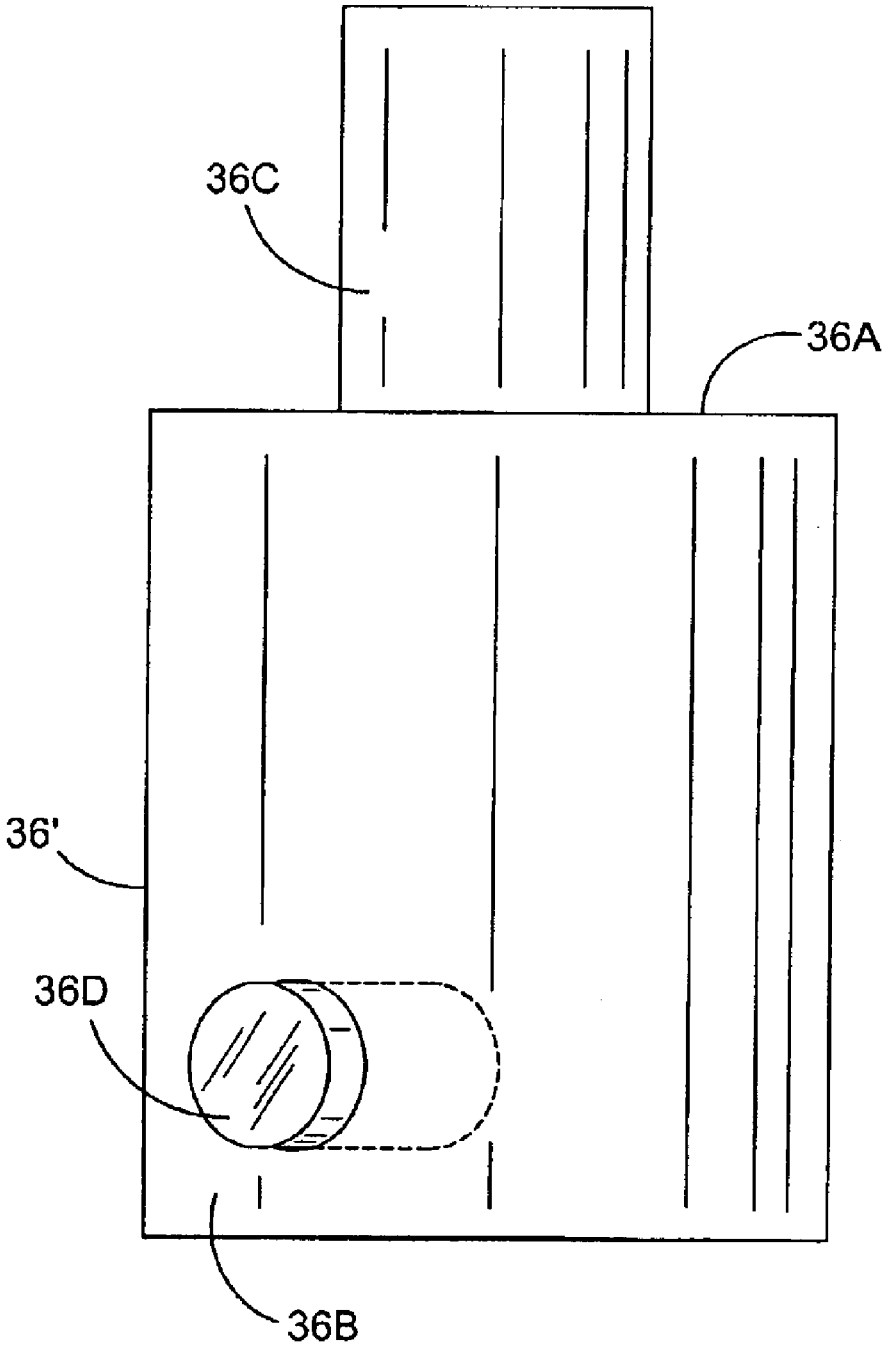
FIG. 7 is an enlarged side elevation of a cylindrical pin per se such as used in the tool.

The ratchet wheel 27 is preferably made integral with the output shaft 23, having a side face 29 facing, although not engaging, a first surface 31 of a wear member 32 (e.g., a washer), which is keyed to engage the internal end portion 26 of the output shaft for rotation with the shaft. As shown in FIGS. 6 and 6A, the washer 32 preferably includes a keyhole 32*a* keyed to the internal end portion 26 of the output shaft 23. The keyhole 32*a* includes at least one flat 32*b* (preferably two) for keying engagement with the internal end portion 26 of the output shaft 23, which includes at least one corresponding flat 32*c* (preferably two). The interaction of the keyhole 32*a* and the internal end portion 26 ensures that the output shaft 23 and washer 32 rotate conjointly, while allowing the washer to move axially with respect to the output shaft, such that the washer can compensate for tool wear. The keyhole 32*a* and internal end portion 26 of the output shaft 23 may be formed into any suitable mating configuration, such as hexagonal or square, without departing from the scope of the invention. Alternately, the keyhole may be provided in the output shaft 23, rather than the wear member 32, for interaction with a key portion of the wear member. The washer 32 includes a second surface 31*a* opposite the first surface 31 for engaging a wear-resistant facing 81 of the annular bearing 71 (hereinafter braking member). Although the annular bearing performs dual functions as both a braking member 71 for the tool and as a journal for the output shaft 23 in the preferred embodiment, it is contemplated that the annular bearing and braking member could be formed as separate components, each performing one of the functions noted above, without departing from the scope of the invention. In accordance with this invention, the ratchet wheel has a plurality of recesses each designated 33 extending inward from its side face 29 spaced at intervals around its axis. Generally, each of these recesses 33 receives an engagement member 36 biased outward from its respective recess, as will be described in greater detail below. More preferably, these engagement members 36 each comprise a coil compression spring 35 and a cylindrical pin 36', one spring and one pin received in each recess (Other engagement members 36, such as springs alone or springs and corresponding ball bearings, are also contemplated). Each spring 35 is compressed between an inner end 37 of the respective recess and a shoulder 36A of the cylindrical pin 36' (FIGS. 2 and 7). The cylindrical pin comprises an engagement portion 36B and a locator portion 36C having a smaller diameter than the engagement portion. The shoulder 36A is located at the intersection of the engagement portion 36B and the locator portion 36C on a second end of the engagement portion. The locator portion is received within the turns of the spring 35, effectively locating the spring on the pin 36'. The engagement portion 36B (on a first end thereof) engages the first surface 31 of the washer 32, thereby applying a force against the washer. Because the washer 32 is keyed to the internal end portion 26 of the output shaft 23, the washer rotates with the output shaft during shaft rotation. Therefore, there is little to no relative angular movement between the washer 32 and the pins 36' as the output shaft 23 rotates, thereby simultaneously rotating the washer. By minimizing relative movement between the washer 32 and the pins 36', there is relatively little wear between the components as they rotate conjointly. This feature helps minimize wear of the pins 36' and the washer 32, thereby extending their useful life.

As the washer 32 and pins 36' rotate with the output shaft 23, the pins 36' press the rotating washer against the non-rotating braking member 71, creating friction between the washer and braking member to inhibit uncalled-for rotation of the output shaft. Specifically, the second surface 31 a of the washer 32 and the wear-resistant facing 81 of the braking member 71 engage one another to produce sufficient friction, which acts as braking means for inhibiting uncalled-for rotation of the ratchet wheel 27 and shaft 23, especially effective for inhibiting retrograde rotation thereof (in either direction). Because the second surface 31*a* of the washer 32 and the wear-resistant facing 81 of the braking member 71 are substantially coextensive, friction between the braking member and the washer is spread over a large area, thereby minimizing wear by spreading the heat due to friction over a larger area. With less wear, the tool 1 may be used for longer periods of time with less maintenance. Furthermore, because the frictional heat is less concentrated, as compared with ball bearings, spring washers or other conventional frictional members, the washer 32, braking member 71 and adjacent components are less susceptible to overheating during extended use.

In one embodiment, the washer 32 and braking member 71 are formed from the same material. Thus, the second surface 31*a* of the washer 32 and the wear-resistant facing 81 of the braking member 71 tend to wear at a similar rate. If the washer 32 and braking member 71 wear a sufficient amount, their effectiveness in inhibiting uncalled-for rotation (e.g., retrograde rotation) of the ratchet wheel 27 and shaft 23 may degrade, although less than conventional configurations. As the washer 32 and braking member 71 wear, the springs 35 acting upon the pins 36' are allowed to lengthen, thereby automatically adjusting for wear. However, according to Hooke's law, the force exerted by the springs 35 on the pins 36' decreases in proportion to the lengthening of the springs, thereby decreasing the friction between the washer 32 and the braking member 71. When the frictional forces are insufficient to inhibit uncalled-for rotation, the worn washer 32 may be replaced by a replacement washer of greater thickness (e.g., equivalent to the thickness of the washer 32 prior to wear), thereby further compressing the springs 35 to increase their exerted force and the subsequent friction between the washer 32 and braking member 71. Although replacement of the washer 32 is contemplated, such replacements are undertaken less frequently than with conventional configurations that rely on ball bearing or spring washer frictional contact. This is due to the increased area of frictional contact between the washer 32 and braking member 71.

The cylindrical pins 36' each further include a detent 36D received through the engagement portion 36B adjacent the periphery of the engagement portion (FIGS. 2 and 7). Each detent 36D engages the ratchet wheel 27 adjacent the corresponding recess 33 receiving the pin 36' to prevent the pin from being pushed fully into the recess. Thus, pin 36' is held in constant engagement with the first surface 31, thereby providing continuous resistance to retrograde rotation of the output shaft 23.

Wear of the washer 32 and/or the braking member 71 is automatically compensated for by expansion of the springs 35, whereby the frictional braking effect is prolonged, without the shimming or more frequent washer replacement previously required. The second surface 31*a* of the washer 32 and the wear-resistant facing 81 of the braking member 71 are substantially coextensive to enhance frictional braking. Moreover, the washer 32 may be made of a material and kind which is substantially the same hardness as the braking member 71 to reduce wear of the washer.

Figure 4:
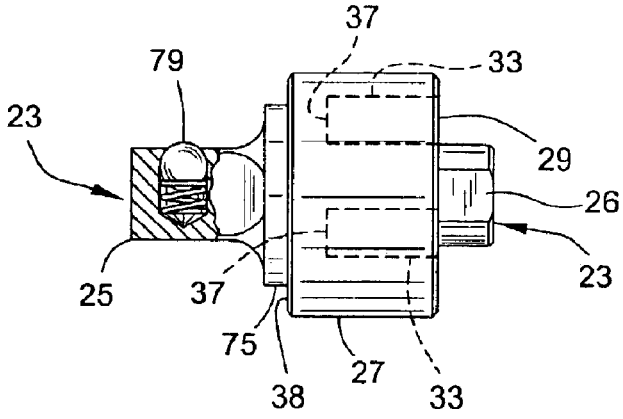
FIG. 4 is a view of the output shaft/ratchet wheel component per se.

In addition to the braking effect described above between the washer 32 and the braking member 71, another braking effect is created due to the ratchet wheel 27 having an opposite side face 38 opposite its aforesaid side face 29 facing and engaging the front wall 19 (FIGS. 2 and 4). The ratchet wheel 27 (and shaft 23) are maintained against movement in the direction (toward the left as shown in FIGS. 1 and 2) toward the front wall 19 under the bias of springs 35 and the compression of the springs is thereby maintained. Frictional engagement of the opposite side face 38 of the ratchet wheel 27 with the front wall 19 adds a braking effect.

Figure 3:
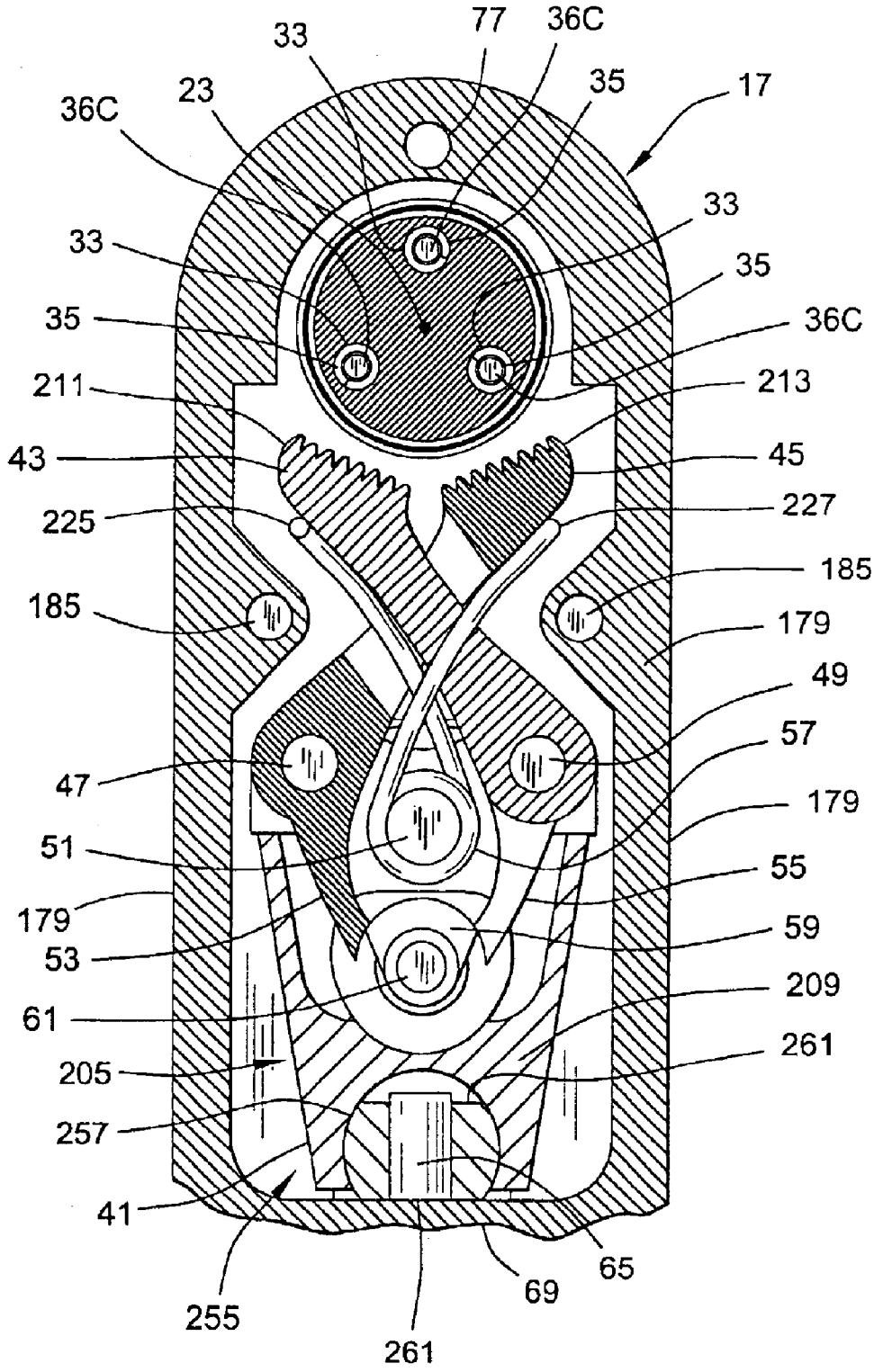
FIG. 3 is a view generally in section on line 3—3 of FIG. 2.
Figure 5:
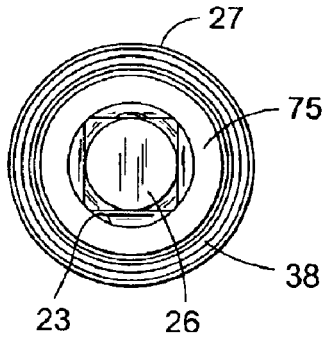
FIG. 5 is a left side elevation of FIG. 4.

As discussed above, the output shaft 23 is journalled at its end opposite the outer end portion 25 in the annular bearing 71, or braking member, lodged in a circular recess 73 in the inside of back wall 21 of housing 17. The ratchet wheel 27 has a disk formation 75 (FIGS. 2, 4 and 5) opposite the side face 29, wherein the disk formation is journalled in a circular opening 76 in front wall 19 (FIG. 2). Opposite side face 38 of the ratchet wheel 27 surrounds this disk formation 75. The front wall 19 is removably mounted by means of screws such as indicated at 77. The outwardly projecting end 25 of output shaft 23 (which is square) has a recess (not numbered) holding spring-backed ball detent 79 for application of the attachment (e.g. socket wrench attachment) for the tool (FIG. 4). Preferentially, three recesses 33 and springs 35 are provided in the ratchet wheel 27, spaced around the axis thereof at 120° intervals (FIGS. 2, 3 and 6). This configuration of recesses 33 and springs 35 provides a substantially uniform force distribution between the washer 32 and braking member 71.

Referring back to FIG. 3, the bidirectional ratchet drive mechanism is powered by shaft 39 of the pneumatic motor M. This mechanism is generally of the same type as that disclosed in the aforesaid '646 U.S. patent and coassigned patent applications. For correlation therewith, there is shown herein pawl carrier 41 ("drive link" 16 of the '646 patent) having the pair of pawls 43 and 45 pivoted thereon at 47 and 49, respectively, and itself pivoted on a pin 51 for oscillation in housing 17 adjacent the rearward end thereof on an axis extending transversely of the housing. The pawls 43, 45 have the tails indicated at 53 and 55, respectively. Indicated at 57 is the spring for biasing the pawls for engagement of the tails with cam 59 on camshaft 61 operable by lever 63 between the position wherein pawl 43 is engageable with the ratchet wheel for driving it one way as viewed in FIG. 3 and the position wherein pawl 45 is engageable with the ratchet wheel for driving it the other way as viewed in FIG. 3. At 65 is indicated the crank driven via gearing indicated at 67 which effects oscillating action of pawl carrier 41 via link 69, oscillation of the pawl carrier effecting rotation of the ratchet wheel 27 and output shaft 23 in one direction or the other depending on the setting of lever 63.

Details of the motor M, valve V, passaging in the body 3 for flow and exhaust of air, and the bidirectional ratchet drive mechanism may be ascertained from the aforesaid '646 patent and coassigned patent applications which, as above noted, are incorporated herein by reference.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A hand-held power tool comprising:

a housing;

a braking member fixedly mounted in said housing;

an output shaft mounted in said housing for rotation in one direction or the other on an axis extending through said housing, said output shaft having an outer end portion projecting out from the housing for reception of an attachment for the tool and a ratchet wheel adapted to be driven in one direction or the other for rotating the output shaft in the one direction or the other, said ratchet wheel having a side face having a plurality of recesses extending inward from said side face spaced at intervals around said axis, wherein a plurality of engagement members are received one engagement member in each recess and biased outward from a corresponding recess; and a wear member rotatable with the output shaft in one direction or the other, wherein said side face of the ratchet wheel faces a first surface of the wear member and said engagement members engage said first surface of the wear member to bias a second surface of the wear member, opposite said first surface, against the braking member for holding the ratchet wheel against rotation in a direction opposite the driven direction of rotation.

2. A hand-held power tool as set forth in claim 1 wherein each engagement member comprises a coil compression spring for biasing outward from a corresponding recess.

3. A hand-held power tool as set forth in claim 2 wherein each engagement member further comprises a cylindrical pin spring-biased outward from a corresponding recess by one of said coil compression springs.

4. A hand-held power tool as set forth in claim 3 wherein each cylindrical pin comprises an engagement portion having a first end engageable with the first surface and a locator stud disposed on a second end of the engagement portion opposite the first end, the locator stud having a smaller transverse dimension than the engagement portion and being received internally of said coil compression spring.

5. A hand-held power tool as set forth in claim 3 having three of said recesses, each containing one of said springs and one of said pins, spaced at 120° intervals around the axis of the ratchet wheel.

6. A hand-held power tool as set forth in claim 3 wherein said wear member is substantially annular in shape.

7. A hand-held power tool as set forth in claim 6 wherein said wear member is keyed to the output shaft to ensure conjoint rotation of the wear member and output shaft.

8. A hand-held power tool as set forth in claim 7 wherein said wear member comprises a washer having a keyhole keyed to said output shaft.

9. A hand-held power tool as set forth in claim 8 wherein said keyhole includes at least one flat for keying engagement with said output shaft.

10. A hand-held power tool as set forth in claim 1 wherein said wear member is substantially annular in shape.

11. A hand-held power tool as set forth in claim 10 wherein said wear member is keyed to the output shaft to ensure conjoint rotation of the wear member and output shaft.

12. A hand-held power tool as set forth in claim 11 wherein said wear member comprises a washer having a keyhole keyed to said output shaft.

13. A hand-held power tool as set forth in claim 12 wherein said keyhole includes at least one flat for keying engagement with said output shaft.

14. A hand-held power tool as set forth in claim 1 wherein said housing further comprises front and back walls.

15. A hand-held power tool as set forth in claim 14 wherein said front wall is removable and said braking member is mounted on the back wall, said side face of the ratchet wheel facing the back wall.

16. A hand-held power tool as set forth in claim 15 wherein said ratchet wheel has an opposite side face facing and engaging the front wall to thereby maintain the ratchet wheel and output shaft from movement in the direction of the front wall under the bias of the engagement members.

17. A hand-held power tool as set forth in claim 1 having three of said recesses, each containing one of said engagement members spaced at 120° intervals around the axis of the ratchet wheel.

* * * * *